US008178809B2

(12) United States Patent
Bauer et al.

(10) Patent No.: US 8,178,809 B2
(45) Date of Patent: May 15, 2012

(54) RAILROAD TOGGLE SWITCH

(75) Inventors: Heinz Bauer, Taufkirchen (DE); Andreas Bauer, Kirchberg (DE)

(73) Assignee: Schaltbau GmbH, Munich (DE)

( * ) Notice: Subject to any disclaimer, the term of this patent is extended or adjusted under 35 U.S.C. 154(b) by 304 days.

(21) Appl. No.: 12/616,022

(22) Filed: Nov. 10, 2009

(65) Prior Publication Data

US 2010/0116636 A1 May 13, 2010

(30) Foreign Application Priority Data

Nov. 13, 2008 (DE) ..... 10 2008 057 148

(51) Int. Cl.
*H01H 3/42* (2006.01)
*H01H 23/02* (2006.01)

(52) U.S. Cl. ..... 200/574; 200/558; 200/573

(58) Field of Classification Search ..... 200/17 R, 200/18, 61.85, 61.87, 61.88, 501, 553, 556, 200/558, 573, 574, 302.1, 302.3, 329–332, 200/335

See application file for complete search history.

(56) References Cited

U.S. PATENT DOCUMENTS 585,915 A * 7/1897 Johnston ..... 379/320
936,775 A * 10/1909 Grinnell ..... 200/553
1,724,442 A * 8/1929 Wesson ..... 246/143
1,794,193 A * 2/1931 McKerlie ..... 200/1 A
2,242,167 A 5/1941 Bentley et al.
2,804,527 A * 8/1957 Snyder et al. ..... 200/558
2,952,750 A * 9/1960 Mason ..... 200/19.12
3,251,238 A 5/1966 Fuqua
3,657,493 A * 4/1972 Horsley ..... 200/6 B
3,746,812 A * 7/1973 Kluge et al. ..... 200/574
4,052,578 A * 10/1977 Hoke ..... 200/574
4,215,257 A * 7/1980 Repplinger ..... 200/437
4,313,349 A 2/1982 Heitman et al.
4,796,480 A * 1/1989 Amos et al. ..... 74/483 R

FOREIGN PATENT DOCUMENTS

DE 94 02 338 U1 2/1994
DE 20 2007 014 292 U1 10/2007
GB 499496 A 7/1937
JP 49-127907 U 7/1974

* cited by examiner

*Primary Examiner* — Michael Friedhofer
(74) *Attorney, Agent, or Firm* — Kilpatrick Townsend & Stockton LLP

(57) ABSTRACT

The present invention relates to a railroad toggle switch for a plurality of switching positions, the toggle switch comprising a housing, an operating lever supported on the housing and having a pivot axis, a switching cylinder supported on the housing and having a rotational axis, a plurality of microswitches and an engaging mechanism for engagement of the operating lever in the switching positions. The switching cylinder is here provided with a plurality of cam disks for operating the microswitches. According to the invention the pivot axis of the operating lever is located in the area of the housing top side and is different from the rotational axis of the switching cylinder, the operating lever being in engagement with the switching cylinder.

15 Claims, 6 Drawing Sheets

RAILROAD TOGGLE SWITCH

CROSS-REFERENCES TO RELATED APPLICATIONS

This application claims the priority of German Application No. 10 2008 057 148.2, filed on Nov. 13, 2008, the disclosure of which is incorporated herein by reference.

BACKGROUND OF THE INVENTION

The present invention relates to a railroad toggle switch.

The railroad toggle switch is conceived for a plurality of switching positions and comprises a housing, an operating lever supported on the housing and having a pivot axis, a switching cylinder supported on the housing and having a rotational axis, a plurality of microswitches and an engaging mechanism for engagement of the operating lever in the switching positions. The switching cylinder normally includes a plurality of cam disks for operating the microswitches.

Such a railroad toggle switch has been known from the prior art since a long time and is used in the control panels of trains, subways, etc. In these railroad toggle switches known from the prior art, the operating lever is made integral with the switching cylinder or is firmly connected thereto. The pivot axis of the operating lever is thus coincident with the rotational axis of the switching cylinder. The outer dimensions of the railroad toggle switch are mostly standardized by the train manufacturers, whereby exchangeability in the control panels is to be ensured.

As a result of the standardization of the outer dimensions of the railroad toggle switches, both the number of the microswitches that can be operated by the switching cylinder and the possible switching positions are limited. In the construction of a railroad toggle switch known from the prior art, the microswitches are arranged at the side of the switching cylinder that is opposite the operating lever, i.e. underneath the switching cylinder. A schematic illustration of a railroad toggle switch known from the prior art is shown in FIG. 1. The engaging mechanism is not illustrated. In the direction of the rotational axis of the switching cylinder, several microswitches are arranged one after the other. The maximally possible number of microswitches is given by the standardized outer dimensions of the railroad toggle switch and by the minimum dimensions of the microswitches which are needed because of the desired switching capacity. An arrangement of additional microswitches e.g. at the right or left side of the switching cylinder is not possible due to the closeness of the rotational axis of the switching cylinder to the housing top side and due to the associated limited space conditions. If the rotational axis of the switching cylinder, which constitutes the pivot axis of the operating lever at the same time, was displaced further downwards, the operating lever could no longer be pivoted to a sufficient degree. As a rule, three switching positions are possible in the railroad toggle switches known from the prior art. If more than three switching positions are desired, which is imperative for an independent operation of a plurality of microswitches, the pivotal range of the operating lever must also be enlarged. This is only possible if the pivot axis of the operating lever is moved further to the housing top side. However, since the pivot axis of the operating lever coincides with the rotational axis of the switching cylinder, this prevents a lateral arrangement of the microswitches. A further drawback of the railroad toggle switches known from the prior art is an inadequate splash-water protection due to the relatively large housing opening that is needed for pivoting the operating lever. The opening is the larger the more the pivot axis of the operating lever is positioned underneath the housing top side. At any rate a sealing of the housing opening turns out to be difficult and can only be accomplished in an inadequate manner. The railroad toggle switches are preferably installed on horizontal control panels. Since in the railroad toggle switches known from the prior art the microswitches must imperatively be arranged underneath the switching cylinder, the poor splash-water protection is further deteriorated as water that has penetrated through the inlet opening can drip in unhindered fashion via the switching cylinder onto the microswitches. A further drawback of the railroad toggle switches known from the prior art is that the pivot angle of the operating lever is bound to be coupled with the necessary rotation of the switching cylinder and turns out to be relatively large as a rule.

Moreover, DE 741078 reveals a cord switch for operating a heating pad. The cord switch comprises a housing, a switching drum, and an operating lever. Terminals arranged on the housing are connected, depending on the switching position, directly by the switching drum or by a conductor extending through the switching drum. To ensure the necessary switching capacity in the case of several switching positions, a transmission device is provided between the operating lever and the switching drum, by which device the rotational angles of the operating lever become smaller than the rotational angles of the switching drum. The switch is not designed for operating microswitches. The housing opening required for operating the operating lever is very large and does not provide adequate protection against splash water.

Since in modern trains more and more devices and functions are served from the control panel, there is a demand for toggle switches by which additional switching positions and the operation of additional microswitches are realized with the same outer dimensions of the railroad toggle switches. Moreover, the demand for additionally operable microswitches is already justified by the fact that in modern transportation systems not only the corresponding device or the desired function has now to be activated by operating a toggle switch, but an information signal must also be sent to the on-board computer by simultaneously operating an additional microswitch.

BRIEF SUMMARY OF THE INVENTION

It is therefore an object of the present invention to provide a railroad toggle switch by which, on the one hand, more microswitches can be operated than with the railroad toggle switches known from the prior art and by which, on the other hand, more switching positions can be implemented. Moreover, the further drawbacks of the railroad toggle switches known from the prior art shall be overcome.

The object is achieved if the pivot axis of the operating lever is located in the area of the housing top side and differs from the rotational axis of the switching cylinder. Furthermore the operating lever is in engagement with the switching cylinder. The arrangement according to the invention yields considerable advantages. Owing to the arrangement of the rotational axis of the switching cylinder in a way independent of the pivot axis of the operating lever it is possible to provide the necessary space for arranging more microswitches around the switching cylinder. Owing to the arrangement of the pivot axis of the operating lever in the area of the housing top side the housing opening needed for the operating lever can be kept small in size, resulting in improved protection against splash water. Since the operating lever is not firmly connected to the switching cylinder, but is in engagement with said cylinder it is possible to implement an appropriate transmission ratio between operating lever and switching cylinder. It is thereby possible to obtain the rotational angles of the switching cylinder needed for the switching operation at relatively small pivot angles of the operating lever.

In a preferred embodiment, operating lever and switching cylinder are in engagement via gear segments. To this end a first gear segment is connected to the operating lever and a second gear segment is connected to the switching cylinder. It is thereby possible to establish a gear ratio between operating lever and switching cylinder. For instance if small pivot angles of the operating lever are desired for the operation, the necessary rotational angles of the switching cylinder can be achieved through a corresponding gear ratio. As an alternative, engagement and transmission can also be accomplished by way of a sliding joint.

In a further preferred embodiment the cam disks are arranged to be individually exchangeable on the switching cylinder. If some or all microswitches are arranged at a different place of the switching cylinder or also more microswitches are positioned around the switching cylinder, there is no need for exchanging the whole switching cylinder. It is enough when the corresponding cam disks are adapted or rotated on the switching cylinder relative to the remaining cam disks. An adaptation can also be made when a microswitch is to be operated in a switching position differing from the original one.

Preferably, the second gear segment connected to the switching cylinder is configured as part of one of the cam disks. To this end gear segment and cam disk can be made in once piece.

In a further preferred embodiment the gear rim of one of the two gear segments is laterally completed by walls. The walls extend in radial extension up to the tips of the teeth. It can thereby be prevented that the gear segments are displaced laterally relative to one another. It is thereby ensured that the gear segments are always in perfectly meshing engagement with one another.

In a further preferred embodiment the engaging mechanism comprises at least one notch element that is connected to the operating lever and has one notch per switching position and one locking cam per notch element. The locking cam is arranged on a lever arm which is spring-supported on the housing and engages in one switching position into the notch of the notch element corresponding to the switching position.

Preferably, the engaging mechanism comprises two notch elements, the two notch elements being arranged in symmetry at both sides of the first gear segment and connected to the first gear segment. A respective locking cam is provided as a counter piece for each notch element. Both locking cams are jointly arranged on the spring-supported lever arm. Thanks to the symmetric arrangement, any one-sided load on the mechanism and thus any jamming is prevented and ease of operation of the railroad toggle switch is ensured.

Preferably, the locking cams are not firmly connected to the lever arm, but are configured as a roller that is rotatably supported on the lever arm. Upon operation of the railroad toggle switch the rollers are rolling on the associated notch elements, whereby the ease of operation of the railroad toggle switch is further enhanced.

In a further preferred embodiment, the microswitches are arranged laterally next to the switching cylinder at one side of the switching cylinder. Thanks to the lateral arrangement the microswitches are protected in an improved way against splash water in comparison with an arrangement underneath the switching cylinder.

In case more microswitches are to be operated than can be arranged at one side of the switching cylinder, the microswitches are preferably arranged at both sides of the switching cylinder. It is here also possible to safely protect the microswitches against splash water which may possibly enter because of the housing opening needed for the operating lever.

If more microswitches are to be operated than can be accommodated at both sides of the switching cylinder, the microswitches are preferably arranged at both sides of the switching cylinder and underneath the switching cylinder. The cam disks must be adapted accordingly for this purpose.

The microswitches are preferably pre-mounted on carrier plates. Terminals may also be provided on said carrier plates, the terminals enabling ease of wiring of the railroad toggle switch. The housing preferably comprises accommodating means at both sides of the switching cylinder for fastening the carrier plates.

In a further preferred embodiment the operating lever is supported on the housing in a bearing, the bearing being configured as a ball-and-socket joint. Thanks to the ball-and-socket joint the seal protection against splash water is improved considerably. The operating lever is here freely movable in principle, so that the pivot axis of the operating lever is just an imaginary pivot axis. The ball of the ball-and-socket joint is part of the operating lever; the socket of the ball-and-socket joint is formed by a part of the housing.

Preferably, the ball-and-socket joint comprises a sealing ring. The sealing ring can be inserted into a groove of either the ball or the socket of the ball-and-socket joint and is normally made of rubber or a swelling felt material. Enhanced ease of use is achieved with a felt material.

Since the operating lever is in principle freely movable by way of the ball-and-socket joint, the housing in the area of the bearing preferably comprises guide surfaces for guiding the operating lever. Thanks to these guide surfaces the pivoting direction is clearly defined and the pivot axis of the operating lever is re-established.

BRIEF DESCRIPTION OF THE DRAWINGS

A preferred embodiment shall now be explained in more detail with reference to drawings, in which.

Figure 1:
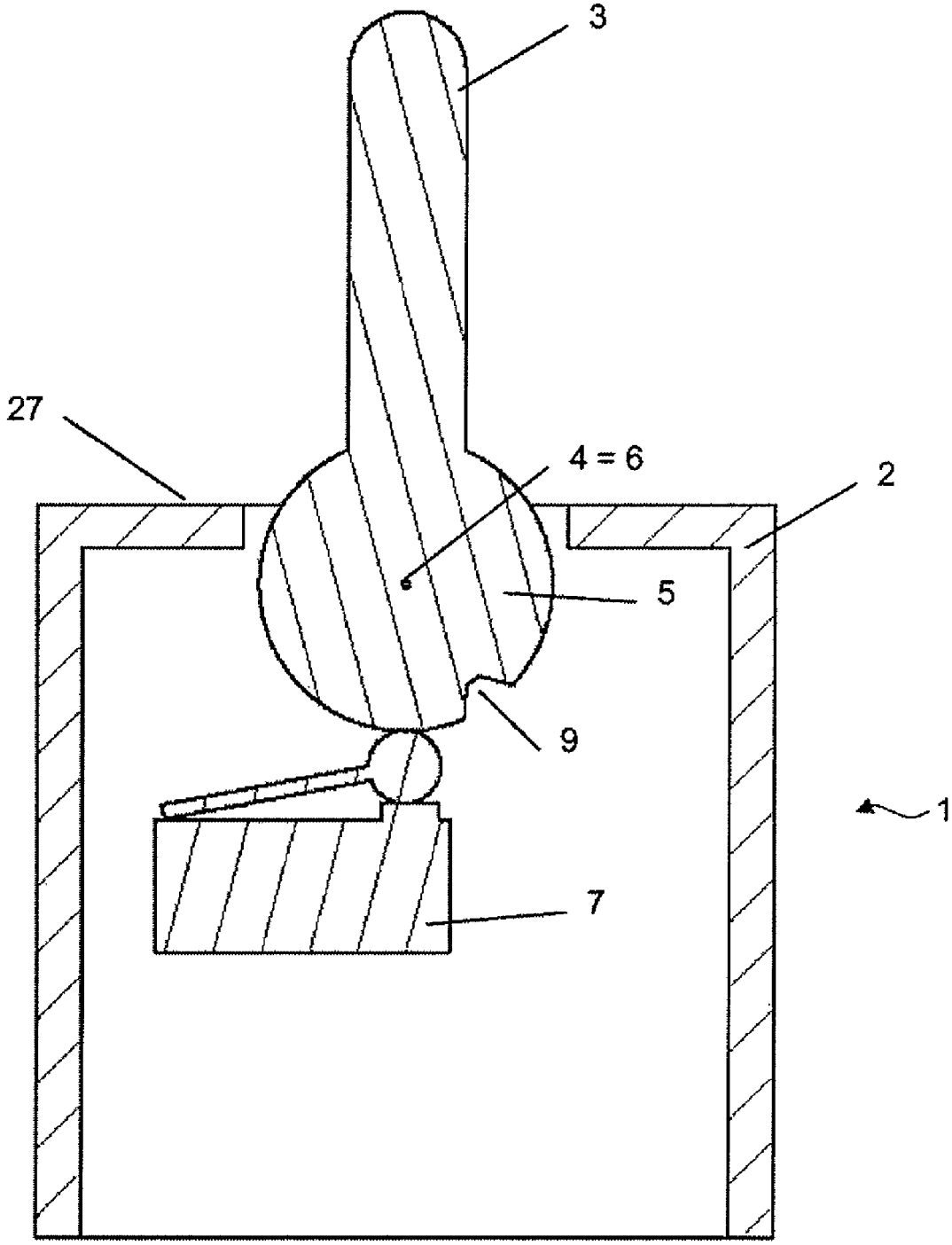
Fig. 1 Prior Art
FIG. 1 is a schematic view of a railroad toggle switch known from the prior art.

As for the whole further description, if reference numerals are included in a figure for the sake of graphical clarity, but if these are not explained in the associated text of the description, reference will be made to their explanation given in preceding descriptions of the figures.

DETAILED DESCRIPTION OF THE INVENTION

FIG. 1 is a schematic view of a railroad toggle switch known from the prior art. The railroad toggle switch itself is designated by reference numeral 1. It comprises the housing 2, the operating lever 3 which is supported on the housing and includes pivot axis 4, the switching cylinder 5 which is rotatably supported on the housing and includes the rotational axis 6, and at least one microswitch 7. In the prior-art railroad toggle switches, pivot axis 4 of the operating lever 3 and rotational axis 6 of the switching cylinder 5 are coincident. The microswitch 7 is operated via corresponding cam disks 9, which are arranged on the switching cylinder 5. The operating lever 3 projects out of an opening (not designated) in the housing top side 27. Not shown is the engaging mechanism of the railroad toggle switch 1 known from the prior art.

Figure 2:
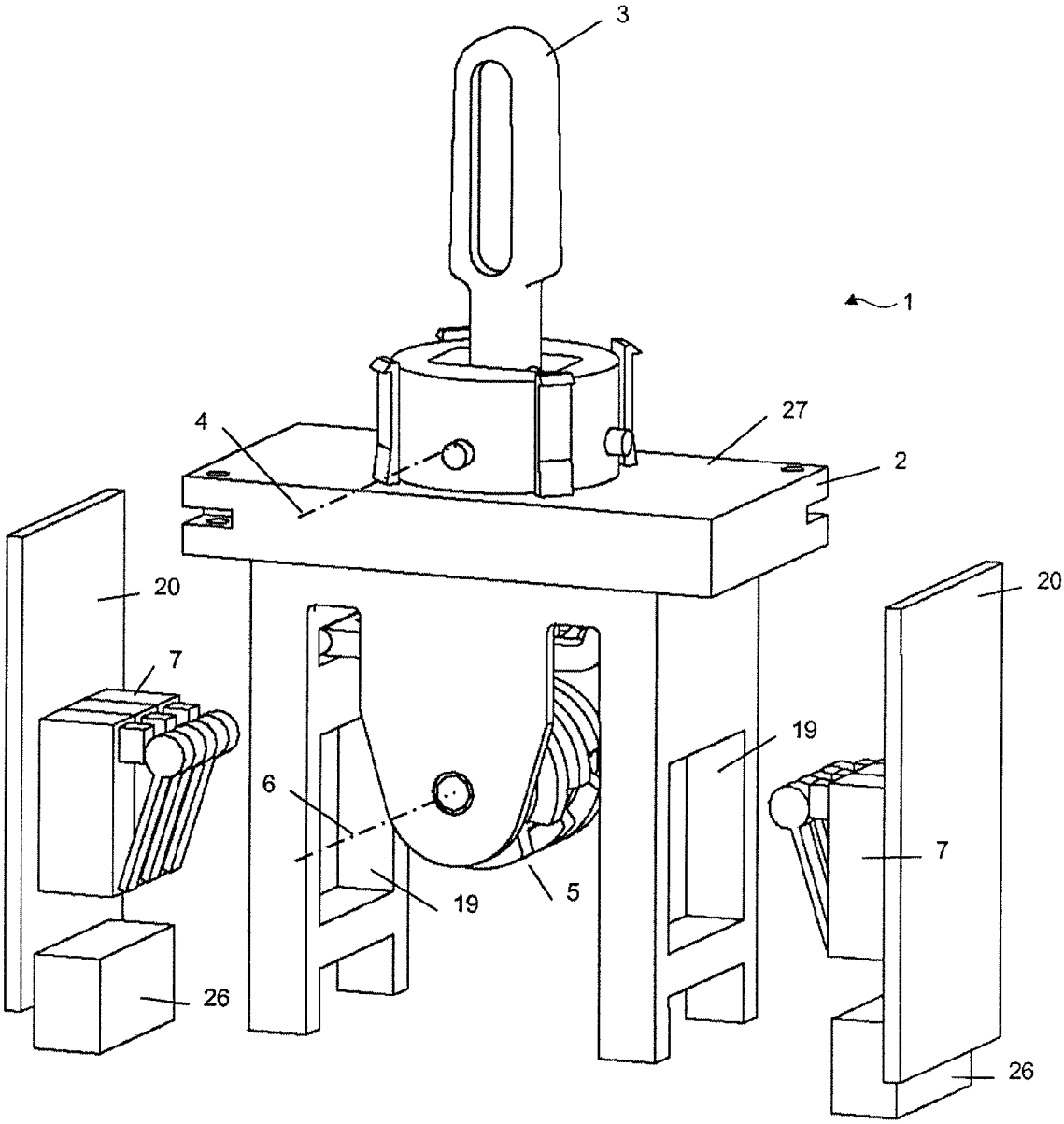
FIG. 2 is an oblique outside view of a railroad toggle switch according to the invention.

FIG. 2 is an oblique view illustrating a railroad toggle switch 1 according to the invention. The pivot axis 4 of the operating lever 3 is different from the rotational axis 6 of the switching cylinder 5 and is arranged in the area of the housing top side 27 of the housing 2. The rotational axis 6 of the switching cylinder 5 is positioned underneath the pivot axis 4 of the operating lever 3. The microswitches 7 are arranged at both sides of the switching cylinder 5. At both sides of the switching cylinder 5 the housing 2 comprises a respective accommodating means 19, each serving to fasten one of the two carrier plates 20. On each of the two carrier plates 20, up to three microswitches 7 can be pre-mounted side by side. The microswitches 7 are connected through a circuitry (not designated) to the terminals 26, which are also mounted on the carrier plates.

Figure 3:
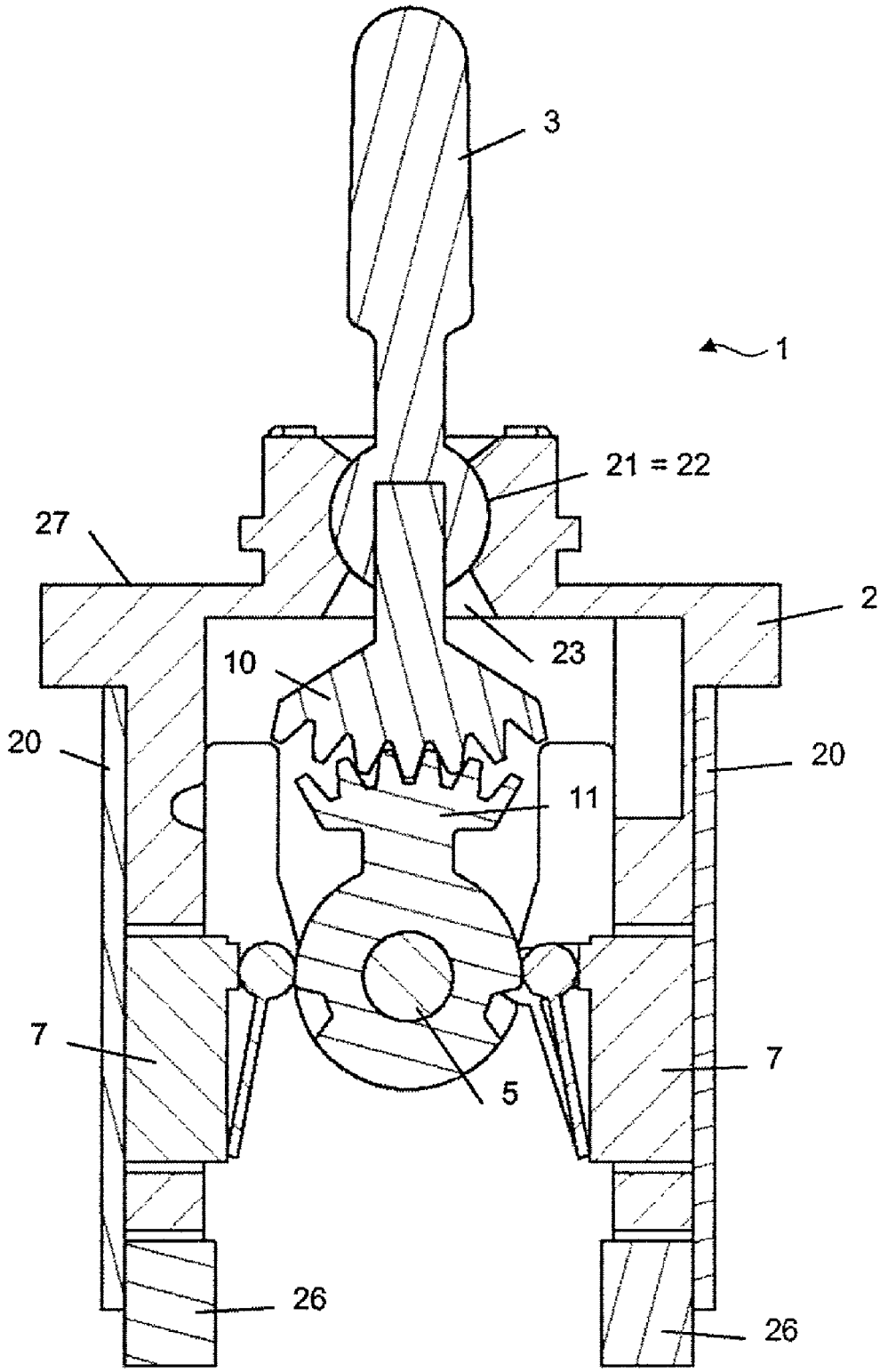
FIG. 3 is a simplified sectional side view of the railroad toggle switch according to the invention of FIG. 2.

FIG. 3 is a sectional schematic view showing the railroad toggle switch according to the invention of FIG. 2. It can clearly be seen here that a first gear segment 10 is connected to the operating lever 3 and a second gear segment 11 to the switching cylinder 5, and operating lever 3 and switching cylinder 5 are in engagement via the two gear segments 10 and 11. Hence, a pivotal movement of the operating lever 3 results in a rotational movement of the switching cylinder 5. The bearing 21 of the operating lever 3 is configured as a ball-and-socket joint 22. The housing 2 is equipped, underneath the bearing 21, with guide surfaces 23 for guiding the operating lever 3. The pivoting direction of the operating lever 3 is thereby defined in the drawing plane. Since FIG. 3 is a schematic view, the engaging mechanism of the railroad toggle switch is not shown.

Figure 4:
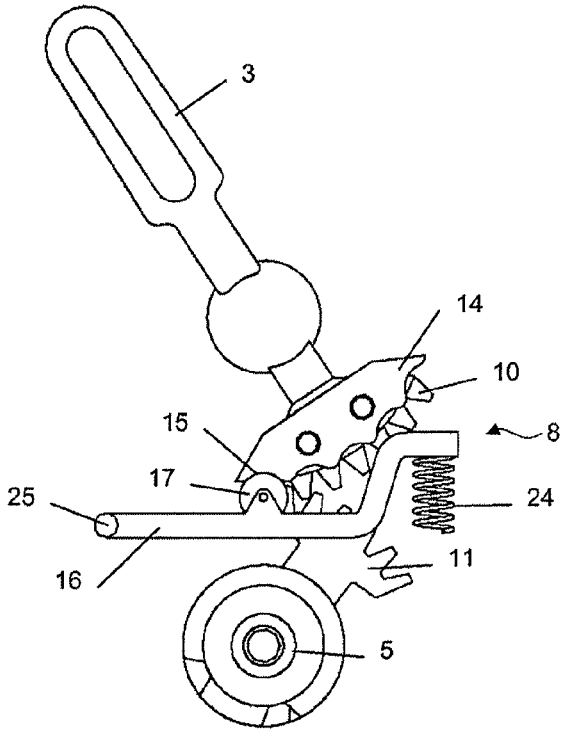
FIG. 4 is a side view of the mechanical switch subassembly of the railroad toggle switch according to the invention of FIGS. 2 and 3, without illustration of the housing.
Figure 5:
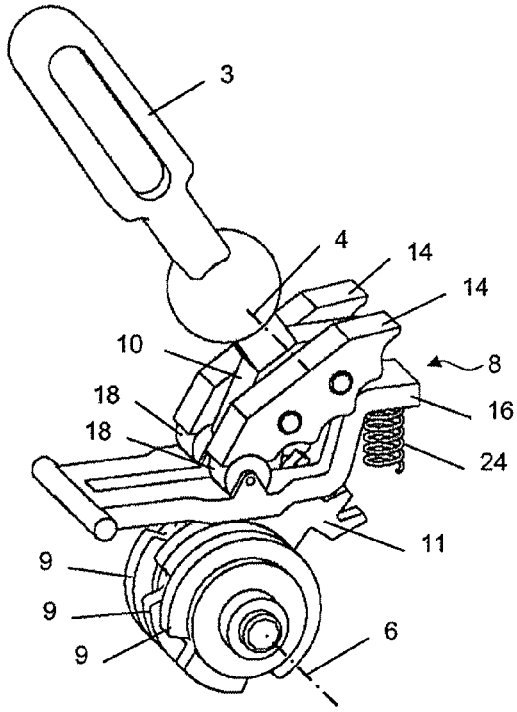
FIG. 5 is an oblique view of the mechanical switch subassembly of FIG. 4.

FIG. 4 shows the mechanical switch subassembly of the railroad toggle switch according to the invention of FIGS. 2 and 3. An oblique view of this illustration is shown in FIG. 5. None of the two FIGS. 4 and 5 shows the housing 2. FIGS. 4 and 5 serve to understand the engaging mechanism 8. At the side of the operating lever 3 the engaging mechanism 8 comprises two notch elements 14 which are arranged at both sides of the first gear segment 10 and are connected to the gear segment 10. At the side of the housing 2 the engaging mechanism 8 comprises a lever arm 16 which is rotatably supported on the housing 2 via a lever arm bearing 25. The lever arm spring 24 supported on the housing 2 has the function that the two locking cams 17 positioned on the lever arm 16 engage in one switching position into the notches 15 of the notch element 14, the notches 15 being assigned to the switching position. As can be seen in FIG. 5, the two locking cams 17 are formed by two rollers 18 rotatably supported on the lever arm 16. In the illustrated configuration, the railroad toggle switch according to the invention is conceived for five switching positions. Moreover, the three cam disks 9 of the switching cylinder 5 can be seen in FIG. 5. The second gear segment 11 is made integral with the central cam disk 9. Thanks to the use of two notch elements 14, which are arranged in symmetry at both sides of the gear segment 10, and thanks to the likewise symmetrical design of the lever arm 16, a one-sided load and a jamming of the switch mechanism is prevented and ease of operation of the railroad toggle switch is ensured.

Figure 6:
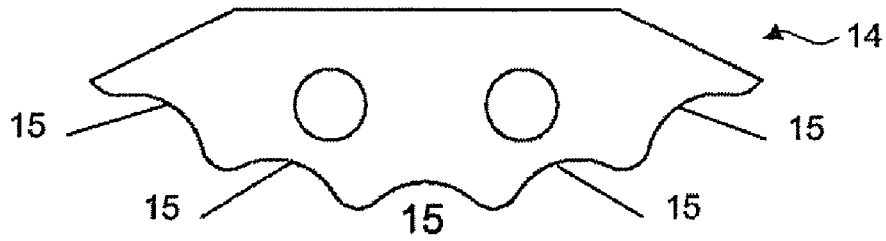
FIG. 6 shows the notch element of the mechanical switch subassembly of FIGS. 4 and 5 for five switching positions.
Figure 7:
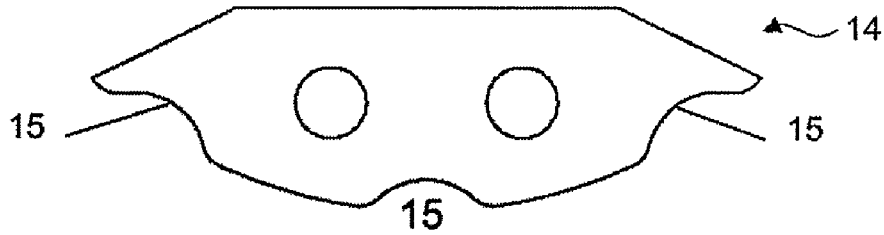
FIG. 7 shows an alternative notch element for three switching positions.
Figure 8:
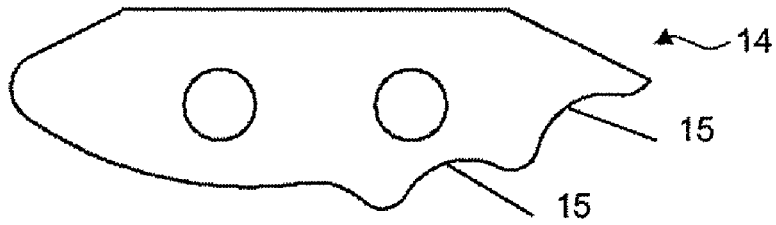
FIG. 8 shows an alternative notch element for two engageable switching positions.
Figure 9:
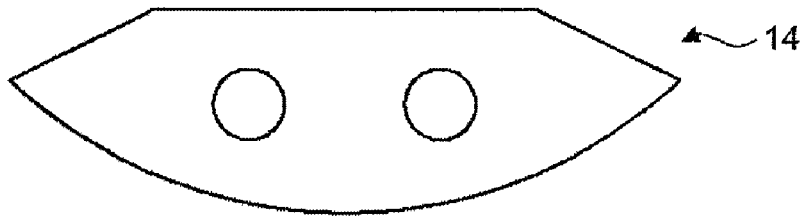
FIG. 9 shows an alternative notch element without any engaging function.

FIG. 6 shows a notch element 14 of the mechanical switch subassembly as shown in FIGS. 4 and 5. The notch element 14 comprises five notches 15, by which five switching positions are realized. FIGS. 7 to 9 show alternative configurations of the notch element 14. For instance, FIG. 7 shows a notch element 14 for three switching positions. The notch element 14 of FIG. 8 is conceived for three or four switching positions, with an engagement taking place only in three switching positions. FIG. 9 shows a notch element 14 without any engaging function. Owing to the use of different notch elements 14 as shown in FIGS. 6 to 9, the railroad toggle switch 1 according to the invention can satisfy different demands with basically the same switch assembly. Different or differently configured switching positions can be achieved by exchanging the notch elements. To this end the cam disks 9 of the switching cylinder 5 must also be adapted or exchanged, if necessary. Likewise, the number of the used microswitches 7 varies in response to the demands made on the railroad toggle switch 1. To this end the carrier plates 20 can be equipped with the microswitches 7 in a varying number.

Figure 10:
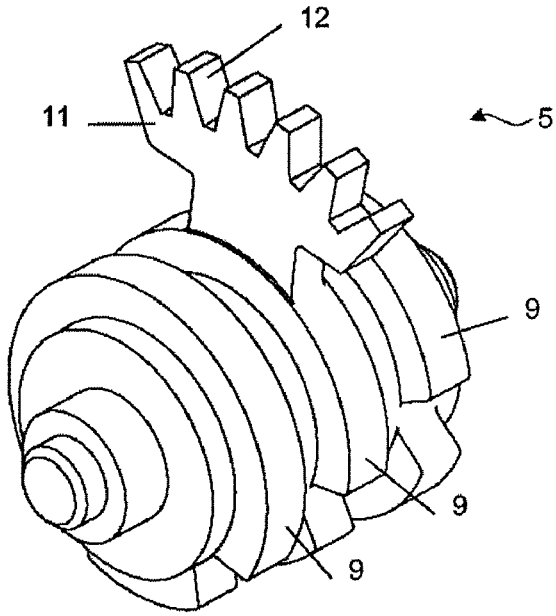
FIG. 10 is an oblique view of the switching cylinder of the railroad toggle switch according to the invention taken from illustrations 2 to 5, with a gear segment.

FIG. 10 is an oblique view showing the switching cylinder 5 as illustrated in FIGS. 2 to 5. The switching cylinder 5 comprises three cam disks 9, the central cam disk 9 being made integral with the second gear segment 11. The gear segment 11 comprises a gear rim 12.

Figure 11:
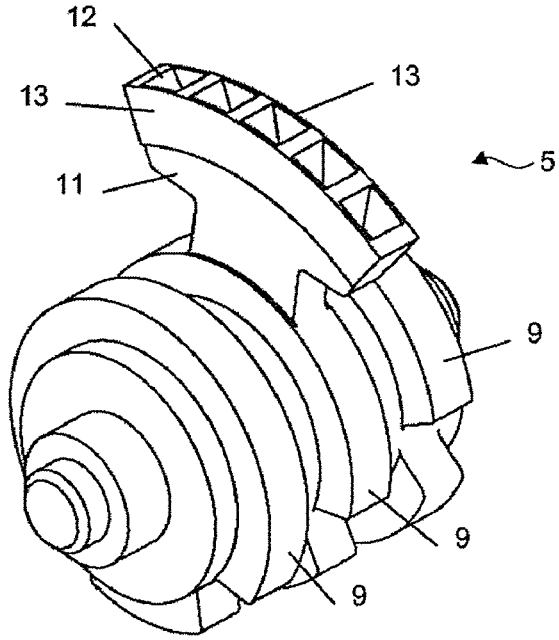
FIG. 11 shows the switching cylinder of FIG. 10 with a preferred embodiment of the gear segment.

FIG. 11 shows the switching cylinder 5 of FIG. 10 with a preferred embodiment of the gear segment 11. The gear rim 12 of the gear segment 11 is here completed laterally up to the height of the teeth by two walls 13. The gear segment 10 (not shown) which is located at the side of the operating lever 3 and engages with the second gear segment 11 is laterally guided by the walls 13. A lateral slipping of the two gear segments 10 and 11 relative to each other is thereby prevented and an optimal engagement is ensured all the time.

The invention claimed is:

1. A railroad toggle switch for a plurality of switching positions, comprising:

a housing;

an operating lever supported on the housing and comprising a pivot axis;

a switching cylinder supported on the housing and comprising a rotational axis;

a plurality of microswitches; and an engaging mechanism for engagement of the operating lever in the switching positions;

the housing comprising a housing top side and the switching cylinder comprising a plurality of cam disks for operating the microswitches;

wherein the pivot axis of the operating lever is located in the area of the housing top side and differs from the rotational axis of the switching cylinder;

wherein the operating lever is in engagement with the switching cylinder;

wherein the microswitches are arranged at least at one side of the switching cylinder;

and wherein the housing at both sides of the switching cylinder comprises accommodating means for fastening carrier plates, the microswitches being mounted on the carrier plates.

2. The railroad toggle switch according to claim 1, wherein a first gear segment is connected to the operating lever and a second gear segment is connected to the switching cylinder, and the first and second gear segments are in mutual engagement.

3. The railroad toggle switch according to claim 2, wherein the second gear segment is part of one of the cam disks.

4. The railroad toggle switch according to claim 2, wherein one of the gear segments comprises a gear rim, the gear rim being configured for laterally guiding the other gear segment being laterally completed by walls in radial extension.

5. The railroad toggle switch according to claim 1, wherein the cam disks are individually exchangeable on the switching cylinder.

6. The railroad toggle switch according to claim 1, wherein the engaging mechanism comprises at least one notch element connected to the operating lever and comprising one notch per switching position and one locking cam per notch element, the locking cam being disposed on a lever arm which is spring-supported on the housing, and engaging in one switching position into the notch of the notch element corresponding to the switching position.

7. The railroad toggle switch according to claim 6, wherein the engaging mechanism comprises two notch elements that are disposed symmetrically at both sides of the first gear segment and connected to the first gear segment, the associated two locking cams being jointly disposed on the spring-supported lever arm.

8. The railroad toggle switch according to claim 6, wherein each of the locking cams comprises a roller rotatably supported on the lever arm.

9. The railroad toggle switch according to claim 1, wherein the microswitches are disposed at both sides of the switching cylinder.

10. The railroad toggle switch according to claim 1, wherein the microswitches are disposed at both sides of the switching cylinder and underneath the switching cylinder.

11. The railroad toggle switch according to claim 1, wherein the pivot axis of the operating lever is an imaginary pivot axis and the operating lever is supported on the housing in a bearing comprising a ball-and-socket joint.

12. The railroad toggle switch according to claim 11, wherein the ball-and-socket joint comprises a sealing ring.

13. The railroad toggle switch according to claim 11, wherein the housing in the area of the bearing comprises guide surfaces for guiding the operating lever.

14. A railroad toggle switch for a plurality of switching positions, comprising:

a housing;

an operating lever supported on the housing and comprising a pivot axis;

a switching cylinder supported on the housing and comprising a rotational axis;

a plurality of microswitches; and an engaging mechanism for engagement of the operating lever in the switching positions;

the housing comprising a housing top side and the switching cylinder comprising a plurality of cam disks for operating the microswitches, wherein the pivot axis of the operating lever is located in the area of the housing top side and differs from the rotational axis of the switching cylinder;

wherein the operating lever is in engagement with the switching cylinder;

wherein the housing, at two opposing sides thereof between which the switching cylinder is arranged such that the rotational axis of the switching cylinder is substantially parallel to said sides, comprises accommodating means for fastening carrier plates, wherein at least one of the carrier plates is fastened to at least one of the accommodating means;

and wherein the microswitches are mounted on the carrier plate or on the carrier plates.

15. A railroad toggle switch for a plurality of switching positions, comprising:

a housing;

an operating lever supported on the housing and comprising a pivot axis;

a switching cylinder supported on the housing and comprising a rotational axis and a plurality of cam disks; and an engaging mechanism for engagement of the operating lever in the switching positions;

wherein the pivot axis of the operating lever differs from the rotational axis of the switching cylinder;

wherein the operating lever is in engagement with the switching cylinder;

and wherein the housing defines at least one opening configured for a carrier plate to be mounted therein, the carrier plate carrying microswitches configured to be operated by the cam disks.

* * * * *